US009520076B2

(12) United States Patent
Wu et al.

(10) Patent No.: US 9,520,076 B2
(45) Date of Patent: Dec. 13, 2016

(54) METHOD AND SYSTEM FOR ADJUSTING WHITE BALANCE, METHOD FOR MAKING LIQUID CRYSTAL DISPLAY

(71) Applicant: Shenzhen China Star Optoelectronics Technology Co., Ltd., Shenzhen, Guangdong (CN)

(72) Inventors: Jinjun Wu, Guangdong (CN); Chih-tsung Kang, Guangdong (CN)

(73) Assignee: Shenzhen China Star Optoelectronics Technology Co., Ltd., Shenzhen, Guangdong (CN)

( * ) Notice: Subject to any disclaimer, the term of this patent is extended or adjusted under 35 U.S.C. 154(b) by 318 days.

(21) Appl. No.: 14/235,546

(22) PCT Filed: Jan. 9, 2014

(86) PCT No.: PCT/CN2014/070365

§ 371 (c)(1),
(2) Date: Jan. 28, 2014

(87) PCT Pub. No.: WO2015/100769

PCT Pub. Date: Jul. 9, 2015

(65) Prior Publication Data

US 2015/0187243 A1 Jul. 2, 2015

(30) Foreign Application Priority Data

Dec. 31, 2013 (CN) ..... 2013 1 0752065

(51) Int. Cl.
*G09G 3/20* (2006.01)

(52) U.S. Cl.
CPC .... *G09G 3/2003* (2013.01); *G09G 2320/0666* (2013.01); *G09G 2360/145* (2013.01)

(58) Field of Classification Search
CPC combination set(s) only.
See application file for complete search history.

(56) References Cited

U.S. PATENT DOCUMENTS

2013/0155121 A1* 6/2013 Kang ..... H04N 9/73 345/690
2014/0160101 A1* 6/2014 Chen ..... G06F 3/1446 345/207
2015/0035993 A1* 2/2015 James ..... H04N 17/04 348/189

FOREIGN PATENT DOCUMENTS

CN 101510393 A 8/2009
CN 10175076 A 6/2010
(Continued)

*Primary Examiner* — Robin Mishler
(74) *Attorney, Agent, or Firm* — Andrew C. Cheng

(57) ABSTRACT

The present invention provides a method for adjusting white-balance, comprising the steps of: S1, entering a value of white-balance of a standard sample into a display panel; S2, controlling the display panel to display a test image having different grayscale value so as to attain a full grayscale value of the display panel; S3, determining whether the attained full grayscale value is within a specification, if yes, then proceeding into next step, and if no, then proceeding into step S4; and S4, recalculating the white-balance value based on a difference between the attained full grayscale value and the white-balance value of the standard sample, and reentering the calculated white-balance value into display panel, and returning to step S2. The white balance adjusting system incorporated with such white balance adjusting method can be readily and quickly implemented into the existing production line of liquid crystal display panel.

15 Claims, 4 Drawing Sheets

(56) References Cited

FOREIGN PATENT DOCUMENTS

| | | | |
|---|---|---|---|
| CN | 101860765 | A | 10/2010 |
| CN | 103067743 | A | 4/2013 |

* cited by examiner

METHOD AND SYSTEM FOR ADJUSTING WHITE BALANCE, METHOD FOR MAKING LIQUID CRYSTAL DISPLAY

FIELD OF THE INVENTION

The present invention relates to the technical field of manufacturing liquid crystal display, and more particularly, to a method and system for adjusting white balance. The present invention also relates to a method for making liquid crystal display.

DESCRIPTION OF PRIOR ART

The liquid crystal displaying device (LCD) is featured with slim and compact displaying equipment. It generally configures with a plurality of colorful or black-and-white pixels arranged in from of a light source or reflecting surface. It features lower energy exhaustion, high displaying quality, compact size, and light-weighted, as a result, it has been widely applied and becomes the main stream of the displaying device. Currently, the liquid crystal display available to the market is generally referred to as backlight liquid crystal display and which includes a liquid crystal display panel and a backlight module. The working principle of the liquid crystal display panel is filling liquid crystal molecules between two paralleled arranged glass substrates, and by applying voltage to the liquid crystal molecules through the glass substrates so as to change its direction, light beam from the backlight module can be exposed to the display and then the image on the display panel is shown.

In the currently available display devices, such as liquid crystal display device, plasma display panel, and rear projection system, each has its own working principle. In addition, the hardware and configuration of each of those devices are different from each other. Because the color restoration is limited by the physical properties of the display panel, in order to push the colorful performance of the display panel to an extent, the parameters of color temperature, contrast, white balance, color conversion array, and gamma value have to be adjusted. As a matter of fact, those parameters are interlinked together, a change of one parameter will surely impact the rest of the parameters. Accordingly, when those parameters are adjusted manually, it takes a long long time. Furthermore, it would be difficult to achieve the same result on different liquid crystal display devices. The performance is low, while the accuracy is poor as well.

In the existing automation, adjustment of the color temperature, white balance and gamma value can be achieved automatically. By generating a video signal to the display panel so as to create and display an image, the color analyzer disposed in front of the display panel can collect data from the screen. And the color analyzer will feedback signals to the display panel after the data is processed. Accordingly, the starting values and variation of the red, green, and blue (RGB) in the white balance can be adjusted. By this arrangement, the RGB can be adjusted. Afterward, a grayscale image will be displayed so as to adjust gamma curve. Accordingly, it needs to collect one thousand and twenty four (1024) images displayed on the display panel so as to conduct the adjustment. Not only lots of time is needed, but also need a complicated calculation method to get the result. Accordingly, this method is not suitable for implementation on the production line.

SUMMARY OF THE INVENTION

In order to resolve the existing technical issues, it is an object of the present invention to a method and system for adjusting white balance and also a method for making liquid crystal display. The white balance adjusting method provided by the present invention can quickly and accurately process the white balance so as to achieve a uniform visual performance among different components thereby reducing the defective rate resulted over-specification of the gamma and chromaticity.

In order to achieve the object set forth above, the present invention provide a method for adjusting white-balance, comprising the steps of:

- S1, entering a value of white-balance of a standard sample into a display panel;
- S2, controlling the display panel to display a test image having different grayscale value so as to attain a full grayscale value of the display panel;
- S3, determining whether the attained full grayscale value is within a specification, if yes, then proceeding into next step, and if no, then proceeding into step S4; and
- S4, recalculating the white-balance value based on a difference between the attained full grayscale value and the white-balance value of the standard sample, and reentering the calculated white-balance value into display panel, and returning to step S2.

Wherein in step S2, the full grayscale data attained thereof is a coordinate value of a white field chromaticity coordinate and a gamma value under the full grayscale value.

Wherein the step S2 includes the following sub-step of:

- S21, controlling the test image of the display panel;
- S22, collecting the brightness and colorfulness of the test image when it is displayed onto the display panel;
- S23, converting the brightness and colorfulness under different grayscale into white field chromaticity and gamma value under different grayscale; and
- S24, simulating a variation curve based on the white field chromaticity coordinate and gamma value according to the attained white field chromaticity and gamma value under tested grayscale, and attaining the white field chromaticity and gamma value of the display panel under full grayscale.

Wherein in step S2, a CCD image sensor is used to collect the brightness and colorfulness of the test image displayed on the display panel.

Wherein the test image has $2^n$ number of different grayscale value, in which $0<n\leq 8$, and n is a positive integer.

Wherein the test sample has sixteen (16) different values of grayscale.

Wherein the specification of the white field chromaticity coordinate is set that the difference between the white field chromaticity coordinate and the white field chromaticity coordinate of the standard sample is located out of ±0.5% of the white field chromaticity of the standard sample; the difference between the gamma value of the display panel and the gamma value of standard sample is within ±0.2.

It is another object of the present invention to provide a white balance adjusting system, including:

- a controlling and managing unit;
- a read and write module: entering a white balance into a display panel under control of the controlling and managing module;
- a display panel: displaying a test image having different grayscale value under control of the controlling and managing module;
- an image collecting module: collecting brightness and colorfulness of the test image when the test image is displayed on the display panel under control of the controlling and managing module; and wherein the controlling and managing module processes the collected values of the brightness and colorfulness attained by the image processing module so as to attain a white field chromaticity coordinate and a gamma value of the display panel under the full grayscale value; determining the attained white field chromaticity value and the gamma value under the full grayscale value is within the specification; recalculating the white-balance value based on a difference between the attained white field chromaticity value and the gamma value under full grayscale value and the white field chromaticity value and the gamma value the standard sample under the full grayscale value.

Wherein the image-collecting module is a CCD image sensor.

It is a third object of the present invention to provide a method for making liquid crystal display and includes assembling display panel and adjusting white balance of the display panel, wherein the method for adjusting the white balance is performed according to the method recited in claim 1.

Wherein in step S2, the full grayscale data attained thereof is a coordinate value of a white field chromaticity coordinate and a gamma value under the full grayscale value.

Wherein the step S2 includes the following sub-step of:

S21, controlling the test image of the display panel;

S22, collecting the brightness and colorfulness of the test image when it is displayed onto the display panel;

S23, converting the brightness and colorfulness under different grayscale into white field chromaticity and gamma value under different grayscale; and S24, simulating a variation curve based on the white field chromaticity coordinate and gamma value according to the attained white field chromaticity and gamma value under tested grayscale, and attaining the white field chromaticity and gamma value of the display panel under full grayscale.

Wherein in step S2, a CCD image sensor is used to collect the brightness and colorfulness of the test image displayed on the display panel.

Wherein the test image has $2^n$ number of different grayscale value, in which $0<n\leq 8$, and n is a positive integer.

Wherein the test sample has sixteen (16) different values of grayscale.

Wherein the specification of the white field chromaticity coordinate is set that the difference between the white field chromaticity coordinate and the white field chromaticity coordinate of the standard sample is located out of ±0.5% of the white field chromaticity of the standard sample; the difference between the gamma value of the display panel and the gamma value of standard sample is within ±0.2.

The white balance adjusting method provided by the present invention can quickly and accurately process the white balance so as to achieve a uniform visual performance among different components thereby reducing the defective rate resulted over-specification of the gamma and chromaticity. The white balance adjusting system incorporated with such white balance adjusting method can be readily implemented into the existing production line of liquid crystal display panel. As a result, the manufacturing process of the liquid crystal display is simplified, and the cost is also reduced.

BRIEF DESCRIPTION OF DRAWINGS

FIG. 4 is an illustration of an adjusted curve of white field chromaticity coordinate made in accordance with the present invention.

DETAILED DESCRIPTION OF PREFERRED EMBODIMENT

In order to give a better and thorough understanding to the whole and other intended purposes, features and advantages of the technical solution of the present invention, detailed description will be given with respect to preferred embodiments provided and illustrated herebelow in accompanied drawings in which same numeral reference is used to refer to the same element through out the drawings.

Figure 1:
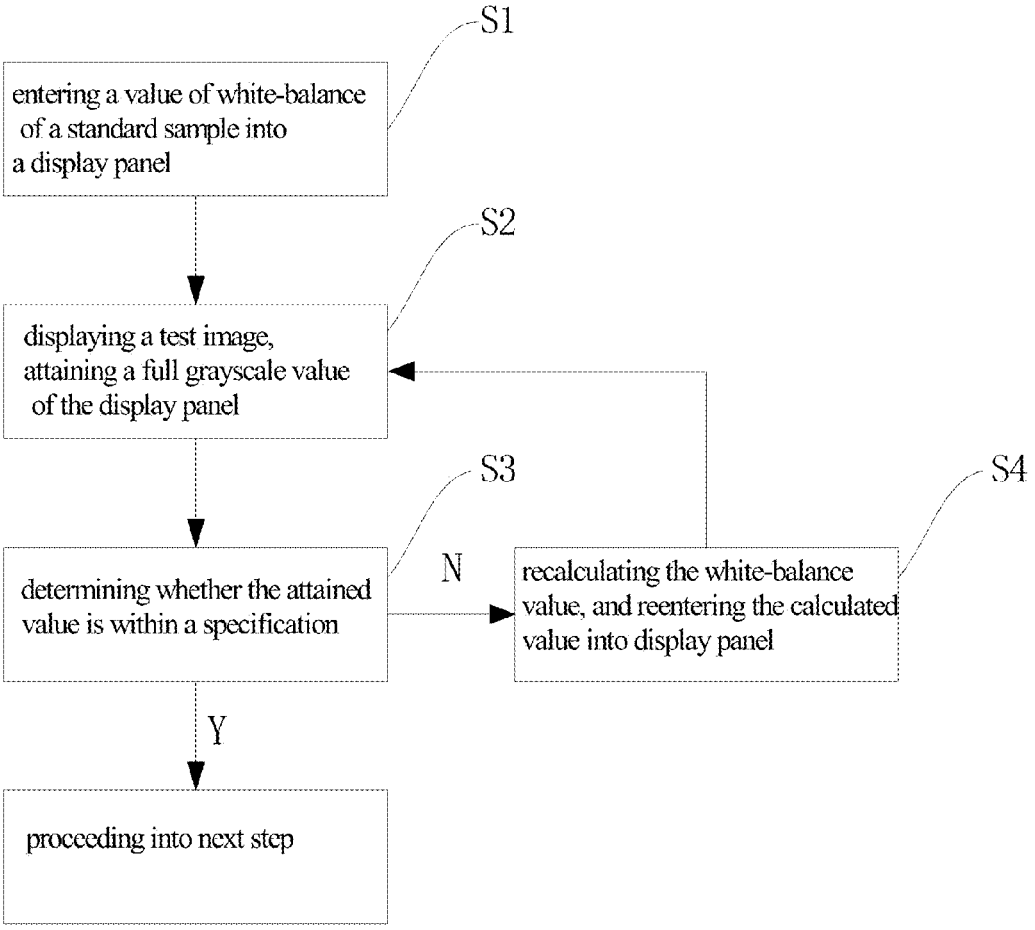
FIG. 1 is a flow chart diagram of a method for adjusting white balance made in accordance with an embodiment of the present invention.

Referring to FIG. 1, a method for adjusting white-balance made in accordance with the present invention includes steps of:

S1, entering a value of white-balance of a standard sample into a display panel;

S2, controlling the display panel to display a test image having different grayscale value so as to attain a full grayscale value of the display panel;

S3, determining whether the attained full grayscale value is within a specification, if yes, then proceeding into next step, and if no, then proceeding into step S4; and S4, recalculating the white-balance value based on a difference between the attained full grayscale value and the white-balance value of the standard sample, and reentering the calculated white-balance value into display panel, and returning to step S2.

Substantially, the data attained in step S2 is white field chromaticity coordinate and gamma value. In step S3, the ranges of the specification of the white field chromaticity coordinate is: when compared to the white field chromaticity coordinates of the standard sample, the difference is within ±0.5% of the white field chromaticity coordinates of the standard sample. In a preferred embodiment, the value of the white field chromaticity coordinate in x-axis is 0.28, and in y-axis is 0.29. The standard ranges of the gamma value is: as compared to the gamma value of the standard sample, it is within ±0.2. In a preferred embodiment, the gamma value of standard sample is 2.2.

Substantially, wherein the step S2 includes the following sub-step of:

S21, controlling the test image of the display panel;

S22, collecting the brightness and colorfulness of the test image when it is displayed onto the display panel;

S23, converting the brightness and colorfulness under different grayscale into white field chromaticity and gamma value under different grayscale; and S24, simulating a variation curve based on the white field chromaticity coordinate and gamma value according to the attained white field chromaticity and gamma value under tested grayscale, and attaining the white field chromaticity and gamma value of the display panel under full grayscale.

Figure 2A:
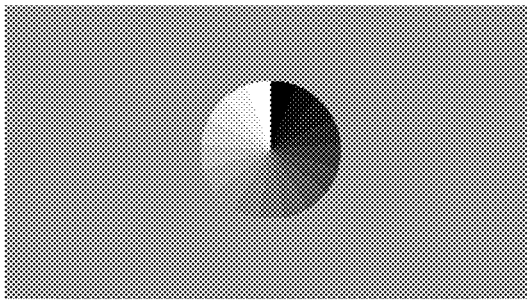
FIG. 2*a* is a test image in accordance with the embodiment of the present invention.

Referring to FIG. 2*a*, the test image provided by the current embodiment is a circular image having sixteen (16) sectors, wherein each of the sixteen (16) sectors has different black and white grayscale values. By collecting the brightness and colorfulness of the test sample when it is displayed on the display panel by the image collecting module, the brightness and colorfulness of those sixteen (16) sectors under different grayscale value. By simulating a variation curve based on the white field chromaticity coordinate and gamma value according to the attained white field chromaticity and gamma value under tested grayscale, and attaining the white field chromaticity and gamma value of the display panel under full grayscale. That is to say, by merely collecting a single screen of the display panel through the image-collecting module, the white field chromaticity coordinate and gamma value of the display panel under the full grayscale can be successfully attained. By this arrangement, a great deal of time in collecting data is saved.

Figure 2B:
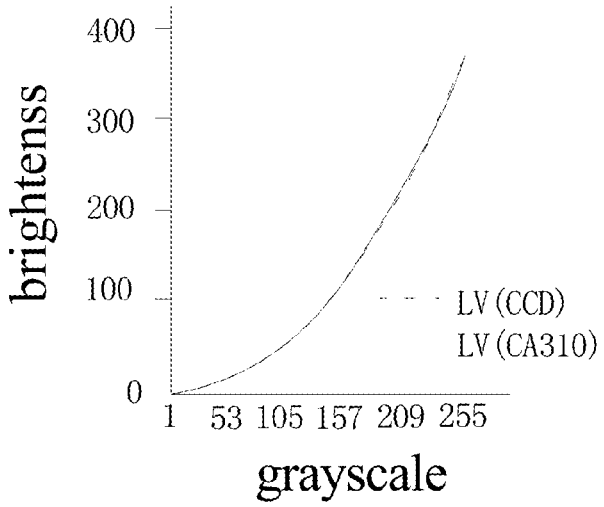
FIG. 2*b* is a comparison chart between a curve of brightness of full grayscale collected from a CCD image sensor, and a curve of brightness of full grayscale collected from a CA310 color analyzer.

Furthermore, in the present embodiment, a charged coupled device, or CCD, has been used as an image sensor to collect the brightness and colorfulness of the test image when it is displayed on the display panel. Since the CCD image sensor can directly convert optical image into digital signal, it can readily facilitate the image process of the collected image. Referring 2*b*, we can use the brightness value under the full grayscale to determine the accuracy of the full grayscale data collected by the CCD image sensor. The dotted line in FIG. 2*b* is a curve of brightness of full grayscale created by simulating the brightness and colorfulness of the sixteen (16) sectors collected from a CCD image sensor, and the solid line in FIG. 2*b* is a curve of variation of brightness of full grayscale collected from a CA310 color analyzer. With the comparison, we can readily find that the consistency of both the dotted line and the solid line are similar. It is concluded that when using the CCD image sensor to collect the grayscale data of the test image displayed on the display panel, the accuracy is very high.

Of course, in other embodiments, the test image can be an image including $2^n$ numbers of sections of grayscale. Wherein $0<n\leq 8$, and n is a positive integer. The smaller the n number, the quick and fast the collection of the brightness and colorfulness of the display panel can be attained. The larger the n number, the longer the collection of the brightness and colorfulness of the display panel can be attained. However, the more accurate of the variation curve of the white field chromaticity value and gamma value can be attained. As a result, the selection of the n number is based on the requirements to the how quickly and accurate the curve wants to be attained.

Figure 3:
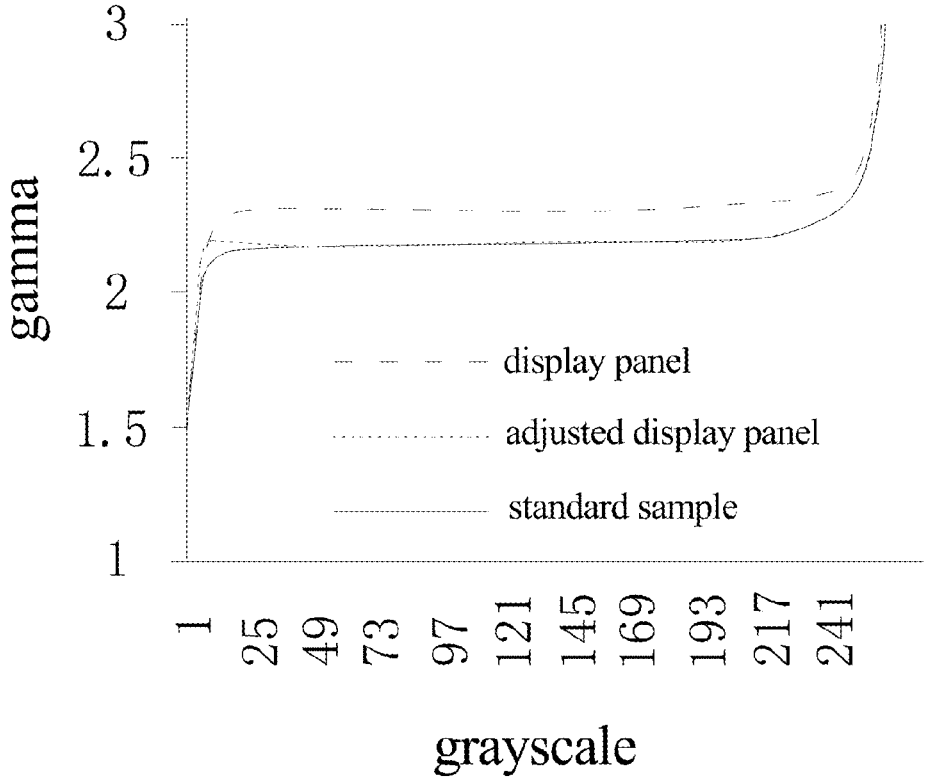
FIG. 3 is an illustration of an adjusted gamma curve in accordance with the present invention.

FIG. 3 is an illustration of an adjusted gamma curve attained with the white balance adjusting method in accordance with the present invention. From the disclosure of FIG. 3, we can readily find out that before the adjustment, the difference between the gamma value of the display panel and the gamma value of standard sample is out of ±0.2, i.e. the gamma value is out of specification. However, after the adjustment through the method of adjusting white balance in accordance with the present invention, the difference between the gamma value of the display panel and the gamma value of standard sample is within ±0.2. Accordingly, it is within the specification, and the display panel can be treated as passed.

Figure 4A:
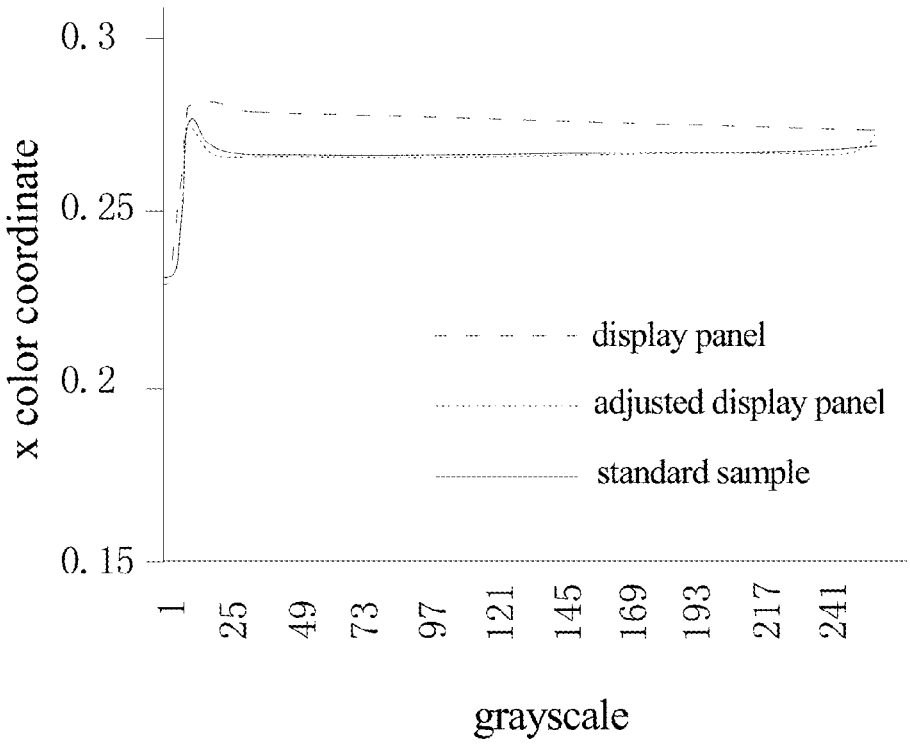
FIG. 4*a* is an illustration of an adjusted curve of white field chromaticity along x-axis.
Figure 4B:
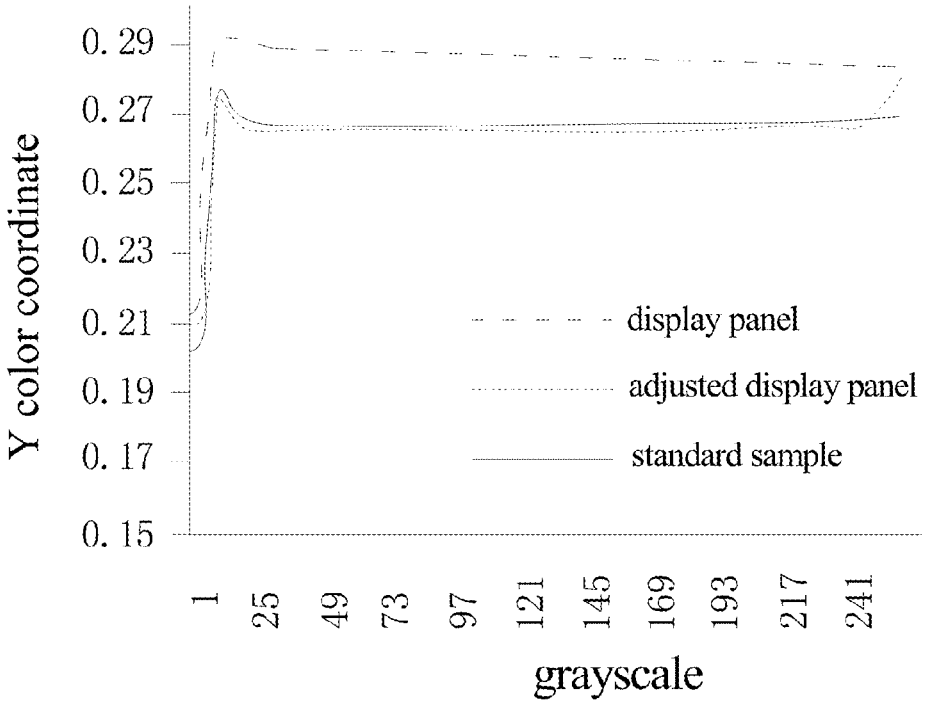
FIG. 4*b* is an adjusted curve of white field chromaticity along y-axis.

Similarly, as shown in FIGS. 4*a* and 4*b*, before the adjustment, the difference between the white field chromaticity coordinate and the white field chromaticity coordinate of the standard sample is located out of ±0.5% of the white field chromaticity of the standard sample. That means that the gamma value of the display panel is out of the specification. However, after it is adjusted by the white balance adjusting method in accordance with the present invention, then the difference between the white field chromaticity coordinate and the white field chromaticity coordinate of the standard sample is located within ±0.5% of the white field chromaticity of the standard sample. Accordingly, it can be concluded as within the specification, and then marked as passed.

By collecting a displayed image with the image-collecting module which implements the white balance adjusting method, the full grayscale value of the display panel can be readily attained. The white balance adjusting method provided by the present invention can quickly and accurately process the white balance so as to achieve a uniform visual performance among different components thereby reducing the defective rate resulted over-specification of the gamma and chromaticity.

Figure 5:
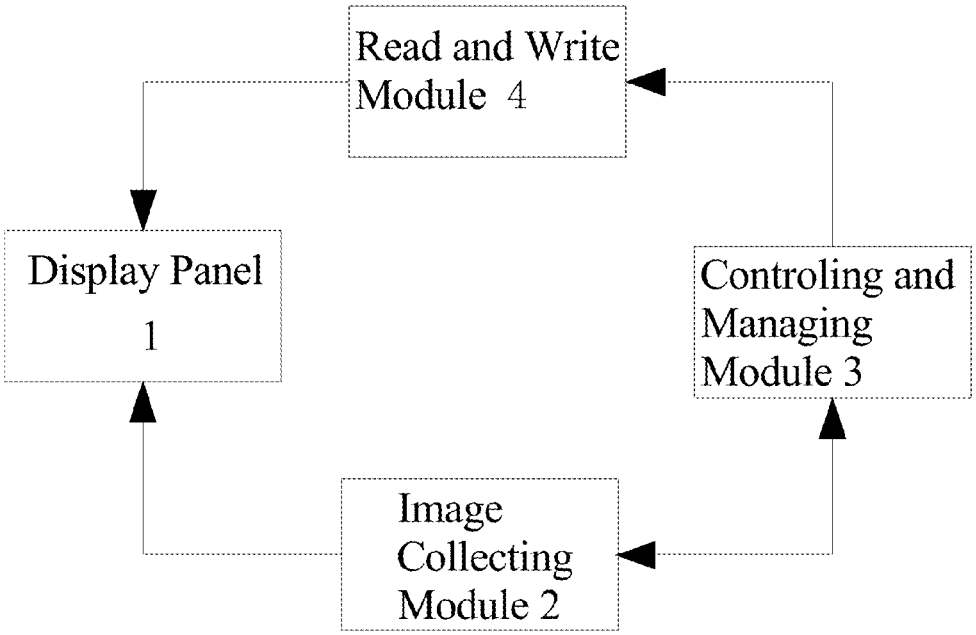
FIG. 5 is an illustration of a white balance adjusting system made in accordance with the present invention.

Referring to FIG. 5, under the same inventive concept, the present invention further provides a white balance adjusting system, and it generally includes:

a controlling and managing unit 3;

a read and write module 4: entering a white balance into a display panel under control of the controlling and managing module 3;

a display panel 1: displaying a test image having different grayscale value under control of the controlling and managing module 3;

an image collecting module 2: collecting brightness and colorfulness of the test image when the test image is displayed on the display panel under control of the controlling and managing module 3; and wherein the controlling and managing module 3 processes the collected values of the brightness and colorfulness attained by the image processing module 2 so as to attain a white field chromaticity coordinate and a gamma value of the display panel 1 under the full grayscale value; determining the attained white field chromaticity value and the gamma value under the full grayscale value is within the specification; recalculating the white-balance value based on a difference between the attained white field chromaticity value and the gamma value under full grayscale value and the white field chromaticity value and the gamma value the standard sample under the full grayscale value.

The test image provided by the current embodiment is a circular image having sixteen (16) sectors, wherein each of the sixteen (16) sectors has different black and white grayscale values. By collecting the brightness and colorfulness of the test sample when it is displayed on the display panel by the image collecting module, the brightness and colorfulness of those sixteen (16) sectors under different grayscale value. By simulating a variation curve based on the white field chromaticity coordinate and gamma value according to the attained white field chromaticity and gamma value under tested grayscale, and attaining the white field chromaticity and gamma value of the display panel under full grayscale. That is to say, by merely collecting a single screen of the display panel through the image-collecting module, the white field chromaticity coordinate and gamma value of the display panel under the full grayscale can be successfully attained. By this arrangement, a great deal of time in collecting data is saved.

Of course, in other embodiments, the test image can be an image including $2^n$ numbers of sections of grayscale. Wherein $0<n\leq 8$, and n is a positive integer. The smaller the n number, the quick and fast the collection of the brightness and colorfulness of the display panel can be attained. The larger the n number, the longer the collection of the brightness and colorfulness of the display panel can be attained. However, the more accurate of the variation curve of the white field chromaticity value and gamma value can be attained. As a result, the selection of the n number is based on the requirements to the how quickly and accurate the curve wants to be attained.

Furthermore, the image-collecting module 2 is implemented by a CCD image sensor. Since the CCD image sensor can directly convert optical image into digital signal, it can readily facilitate the image process of the collected image.

The white balance adjusting system incorporated with such white balance adjusting method can be readily and quickly implemented into the existing production line of liquid crystal display panel. As a result, the manufacturing process of the liquid crystal display is simplified, and the cost is also reduced.

Based on the same inventive concept, the present invention further provides a method for making liquid crystal display and the method includes assembling a liquid crystal display panel, and performing an adjustment of the white balance of the liquid crystal display panel. Wherein the adjusting method for white balance is the white balance adjusting method described above.

In conclusion, the white balance adjusting method provided by the present invention can quickly and accurately process the white balance so as to achieve a uniform visual performance among different components thereby reducing the defective rate resulted over-specification of the gamma and chromaticity. The white balance adjusting system incorporated with such white balance adjusting method can be readily implemented into the existing production line of liquid crystal display panel. As a result, the manufacturing process of the liquid crystal display is simplified, and the cost is also reduced.

It should be noted that in the present invention, the terms of "first" and "second" are merely used to describe the operation of one embodiment over another embodiment, while does not impose any limitations to the substantial differences or operational relationships or orders between the embodiments explicitly or implicitly. Moreover, the term "comprising", "including" or any other variants thereof are intended to cover a non-exclusive inclusion, such that a number of elements including the process, method, article, or device including not only those elements, but also not explicitly listed other elements, or also for such process, method, article, or those elements inherent device. In the case where no more restrictions, by the statement "includes a" qualified elements, including the said element does not exclude a process, method, article or device is also the same as the other elements present.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the claims of the present invention.

The invention claimed is:

1. A method for adjusting white-balance, comprising the steps of:

S1, entering a value of white-balance of a standard sample into a display panel;

S2, controlling the display panel to display a test image having different grayscale value so as to attain a full grayscale value of the display panel;

S3, determining whether the attained full grayscale value is within a specification, if yes, then proceeding into next step, and if no, then proceeding into step S4; and S4, recalculating the white-balance value based on a difference between the attained full grayscale value and the white-balance value of the standard sample, and reentering the calculated white-balance value into display panel, and returning to step S2;

wherein step S2 comprises the following sub-steps:

S21, controlling the test image of the display panel;

S22, collecting brightness and colorfulness of the test image when it is displayed onto the display panel;

S23, converting the brightness and colorfulness under different grayscale into white field chromaticity and gamma value under different grayscale; and S24, simulating a variation curve based on the white field chromaticity coordinate and gamma value according to the attained white field chromaticity and gamma value under tested grayscale, and attaining the white field chromaticity and gamma value of the display panel under full grayscale.

2. The method for adjusting white-balance as recited in claim 1, wherein in step S2, the full grayscale data attained thereof is a coordinate value of a white field chromaticity coordinate and a gamma value under the full grayscale value.

3. The method for adjusting white balance as recited in claim 1, wherein in step S2, a CCD image sensor is used to collect the brightness and colorfulness of the test image displayed on the display panel.

4. The method for adjusting white balance as recited in claim 1, wherein the test image has $2^n$ number of different grayscale value, in which $0<n\leq 8$, and n is a positive integer.

5. The method for adjusting white balance as recited in claim 4, wherein the test image has sixteen (16) different values of grayscale.

6. The method for adjusting white balance as recited in claim 2, wherein the test image has $2^n$ number of different grayscale value, in which $0<n\leq 8$, and n is a positive integer.

7. The method for adjusting white balance as recited in claim 1, wherein the test image has $2^n$ number of different grayscale value, in which $0<n\leq 8$, and n is a positive integer.

8. The method for adjusting white balance as recited in claim 1, wherein the specification of the white field chromaticity coordinate is set that the difference between the white field chromaticity coordinate and the white field chromaticity coordinate of the standard sample is located out of ±0.5% of the white field chromaticity of the standard sample; the difference between the gamma value of the display panel and the gamma value of standard sample is within ±0.2.

9. A method for making liquid crystal display, including assembling liquid crystal display panel and adjusting a white balance of the liquid crystal display panel, wherein the white balance of the liquid crystal display panel is conducted by the method for adjusting white balance as recited in claim 1.

10. The method for making liquid crystal display as recited in claim 9, wherein in step S2, the full grayscale data attained thereof is a coordinate value of a white field chromaticity coordinate and a gamma value under the full grayscale value.

11. The method for making liquid crystal display as recited in claim 9, wherein in step S2, a CCD image sensor is used to collect the brightness and colorfulness of the test image displayed on the display panel.

12. The method for making liquid crystal display as recited in claim 9, wherein the test image has $2^n$ number of different grayscale value, in which $0<n\leq 8$, and n is a positive integer.

13. The method for making liquid crystal display as recited in claim 12, wherein the test image has sixteen (16) different values of grayscale.

14. The method for making liquid crystal display as recited in claim 10, wherein the test image has $2^n$ number of different grayscale value, in which $0<n\leq 8$, and n is a positive integer.

15. The method for making liquid crystal display as recited in claim 9, wherein the test image has $2^n$ number of different grayscale value, in which $0<n\leq 8$, and n is a positive integer.

* * * * *